United States Patent [19]

Mal et al.

[11] 4,194,910

[45] Mar. 25, 1980

[54] SINTERED P/M PRODUCTS CONTAINING PRE-ALLOYED TITANIUM CARBIDE ADDITIVES

[75] Inventors: M. Kumar Mal, Spring Valley; Stuart E. Tarkan, Monsey, both of N.Y.

[73] Assignee: Chromalloy American Corporation, West Nyack, N.Y.

[21] Appl. No.: 918,357

[22] Filed: Jun. 23, 1978

[51] Int. Cl.[2] ..... C22C 9/12; C22C 19/08; C22C 21/20; C22C 38/00

[52] U.S. Cl. ..... 75/236; 75/239

[58] Field of Search ..... 75/239, 236, 203, 204; 148/126

[56] References Cited

U.S. PATENT DOCUMENTS

| | | | |
|---|---|---|---|
| 2,833,638 | 5/1958 | Owen | 75/236 X |
| 3,183,127 | 5/1965 | Gregory et al. | 148/126 X |
| 3,369,891 | 2/1968 | Tarkan | 148/126 X |
| 3,369,892 | 2/1968 | Ellis | 148/126 X |
| 3,653,982 | 4/1972 | Prill | 148/126 X |
| 3,713,788 | 1/1973 | Prill et al. | 75/203 X |
| 3,790,353 | 2/1974 | Jackson et al. | 75/236 |
| 3,811,961 | 5/1974 | Weinstein | 75/236 X |

*Primary Examiner*—Richard E. Schafer

*Attorney, Agent, or Firm*—Hopgood, Calimafde, Kalil, Blaustein and Lieberman

[57] ABSTRACT

P/M products are provided having improved resistance to wear and abrasion by adding controlled amounts of pre-alloyed refractory carbide material to metal powders selected from the group consisting of iron-base, nickel-base, aluminum-base, copper-base and beryllium-base powders following which the mixed powders are compacted and sintered to the desired shape.

11 Claims, 3 Drawing Figures

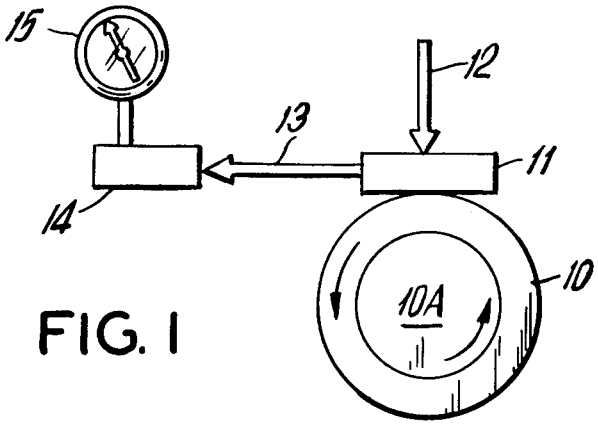
FIG. 1
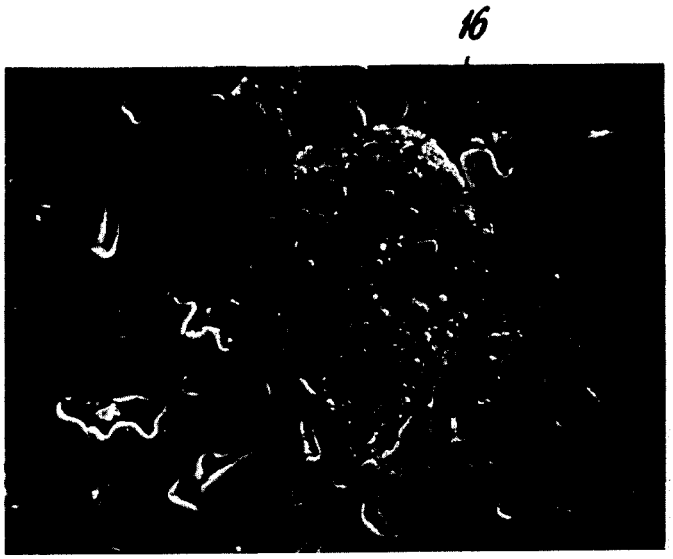
X1000
FIG. 2
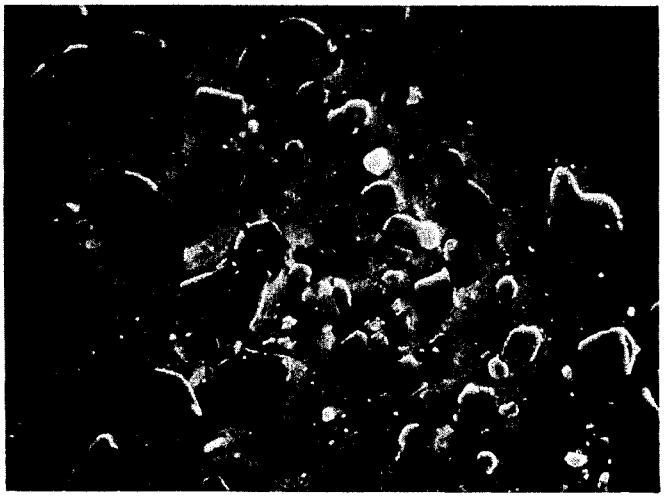
FIG. 3 X4000

SINTERED P/M PRODUCTS CONTAINING PRE-ALLOYED TITANIUM CARBIDE ADDITIVES

This invention relates to powder metallurgy and, in particular, to the production of sintered powder metal shapes (P/M) from iron-base, nickel-base, copper-base, aluminum-base and beryllium-base metal powders wherein said shapes are characterized by improved resistance to wear and abrasion.

BACKGROUND OF THE INVENTION

Considerable progress has been made in recent years in the production of sintered metal articles from iron-base, nickel-base, copper-base, aluminum-base and beryllium-base metal powders such that sintered metal articles or parts are widely used in industry.

However, sintered articles or parts produced from the foregoing metal powders generally find limited use in areas calling for resistance to wear and abrasion, particularly sintered parts made of low carbon steel, certain nickelbase alloys and, of course, parts made of aluminum and copper.

One method which has been proposed for improving the wear resistance of sintered aluminum articles or parts is to incorporate into the aluminum powder mix an effective amount of particles of an alloy selected from the group consisting of nickel and cobalt in the form of a hard intermetallic compound which is dispersed throughout the aluminum matrix in the finely sintered state. The foregoing concept is disclosed in U.S. Pat. No. 4,015,947 (Apr. 25, 1977).

It would be desirable to employ particles of refractory metal carbides as a hard phase but such carbides, particularly titanium carbide, do not bond easily during solid state sintering with such metal powders as aluminum-base and copper-base powders, as well as nickel-base and iron-base powders.

It is known to produce a reinforced heat resistant metal product in which 5% to 20% by volume of a finely divided slip and recovery-inhibiting phase, e.g. carbides, borides, etc., of refractory metals, is mixed with a heat resistant metal, such as an 80-20 nickel-chromium alloy powder and formed into a sintered shape which is thereafter substantially hot worked to a reduction of at least 50% of its original cross sectional area. In this manner, a certain amount of bonding is obtained between the hard phase and the metal matrix by vigorous hot working. Such a process is disclosed in U.S. Pat. No. 2,852,367 (Sept. 16, 1959).

It is important that bonding be achieved between the hard phase and the metal matrix, particularly a non-ferrous metal matrix, so that the hard phase will remain anchored in the matrix in applications involving wear such as occurs in sliding friction; otherwise, the hard phase not adequately bonded tends to be dislodged, thus giving rise to progressive wear of the sintered part which can be accelerated under conditions involving fretting corrosion.

It would thus be desirable to provide a method for producing a sintered shape from iron-base, nickel-base, aluminum-base and copper-base powder in which refractory metal carbides are employed as an additive to confer improved resistance to wear and abrasion to said shape.

OBJECTS OF THE INVENTION

It is an object of the invention to provide a sintered metal product or shape selected from the group consisting of iron-base, nickel-base, aluminum-base and copper-base metals having dispersed therethrough a refractory metal carbide which confers improved resistance to wear and abrasion to said sintered metal shape.

Another object is to provide a method for producing said sintered shape.

These and other objects will more clearly appear when taken in conjunction with the accompanying drawing and the following disclosure wherein:

FIG. 1 is a schematic diagram of a friction and wear testing system employed in determining the coefficient of friction of sintered powder metallurgy compositions relative to a moving surface of high hardness;

FIG. 2 is a representation of a micrograph at 1000 times magnification of a sintered steel composition containing about 4% Cu, 1% C and the balance iron, the steel matrix containing grains of a pre-alloyed titanium carbide tool steel in an amount of 10% by weight of the total sintered composition; and FIG. 3 is a representation of a micrograph at 4000 times magnification of the sintered steel referred to in FIG. 2.

STATEMENT OF THE INVENTION

We have now discovered a method for producing sintered metal shapes characterized by improved resistance to wear and abrasion by employing refractory metal carbides in a special pre-alloyed form as an additive to a material selected from the groups consisting of iron-base, nickel-base, aluminum-base, copper-base and beryllium-base metal powders.

The pre-alloyed refractory carbides are produced by liquid-phase sintering in a metal matrix, such that the surfaces of the carbide grains are modified and bonded to the metal matrix. The pre-alloyed refractory carbide in particulate form comprises particles of the carbide metallurgically combined with the metal matrix, the metal matrix associated with the carbide grains being capable of bonding to the metal power with which the pre-alloyed carbide is mixed.

Pre-alloyed refractory carbides produced by liquid phase sintering are known. In this connection, reference is made to U.S. Pat. Nos. 2,828,202 (Mar. 25, 1958), 3,183,127 (May 11, 1956), 3,416,976 (Dec. 17, 1968), 3,369,891 (Feb. 20, 1968), 3,369,892 (Feb. 20, 1968), 3,653,982 (Apr. 4, 1972) and 3,713,788 (Jan. 30, 1973), among others.

Typical refractory carbides employed in liquid phase sintering with various metal matrices include TiC, VC, NbC and TaC, among other refractory carbides. Sintered shapes produced by liquid phase sintering can be converted easily into finely divided powders by machining the shape and then ball milling the machinings to the desired size using conventional ball milling practice.

Broadly speaking, the pre-alloyed carbide may comprise the following broad compositions: about 15% to 50% by weight of refractory carbide and balance essentially a metal matrix selected from the group consisting of iron-base and nickel-base metals.

Examples of iron-base metals employed as a matrix material in producing a pre-alloyed refractory metal carbide are as follows:

(1) a matrix containing by weight about 1% to 6% Cr, up to about 6% Mo, up to about 2% V, up to about 3% Co, up to about 2% Ni, about 0.3% to 0.8% C and the balance essentially iron.

(2) a matrix containing by weight about 6% to 12% Cr, about 0.5% to 5% Mo, about 0.6% to 1.2% C, up to about 5% W, up to about 2% V, up to about 3% Ni, up to about 5% Co and the balance essentially iron.

(3) a matrix containing by weight about 3% to 7% Cr, about 2% to 6% Mo, about 0.1% to 1% Ni, about 0.3% to 0.7% C and the balance essentially iron.

An example of a nickel-base alloy matrix for producing a pre-alloyed refractory carbide composition by liquid phase sintering is as follows:

(A) a matrix containing about 5% to 30% Cr, up to about 15% Fe, about 0.5 to 5% Ti, about 0.2 to 5% Al, up to about 25% Co, up to about 0.5% C and the balance at least about 40% nickel.

All of the pre-alloyed refractory carbide alloys are produced similarly by liquid phase sintering. As illustrative of a typical method employed in producing the pre-alloyed refractory carbide material, the following example is given with respect to producing a steel-bonded titanium carbide composition containing by weight 33% TiC in the form of primary grains dispersed through a steel matrix containing by weight 3% Cr, 3% Mo, 0.6% C and the balance essentially iron.

In producing a titanium carbide tool steel of the foregoing composition, 500 grams of TiC (of about 5 to 7 microns in size) are mixed with 1000 grams of steel-forming ingredients in a mill half filled with stainless steel balls. To the powder ingredients is added one gram of paraffin wax for each 100 grams of mix. The milling is conducted for about 40 hours, using hexane as a vehicle.

After completion of the milling, the mix is removed and dried and compacts of a desired shape pressed at about 15 t.s.i. and the compacts then subjected to liquid phase sintering in vacuum at a temperature of about 2640° F. (1450° C.) for about one-half hour at a vacuum corresponding to 20 microns of mercury or better. After completion of the sintering, the compacts are cooled and may then be annealed by heating to about 1650° F. (900° C.) for 2 hours followed by cooling at a rate of about 27° F. (15° C.) per hour to about 212° F. (100° C.) and thereafter furnace cooled to room temperature to produce an annealed microstructure comprising pearlite in the form of spheroidite. The annealed hardness is in the neighborhood of about $45R_C$ and the high carbon tool steel composite is capable of being machined and converted to powdered material for use as an additive to metal powder in the production of P/M products (i.e. powder metallurgy products). The titanium carbide grains retain their high intrinsic hardness.

Due to the liquid phase sintering at the aforementioned elevated temperature, a reaction occurs between the surface of the primary refractory carbide grains and the steel matrix whereby enhanced bonding is achieved between the carbide grains and the steel matrix following cooling. The carbide grain superficially dissolves at the edges such that the corners tend to be rounded. Pre-alloyed rounded carbide grains are advantageous as an additive to aluminum in that rounded grains assure the maintenance of low sliding friction as compared to sharply cornered grains, in addition to enhanced resistance to wear and abrasion.

The pre-alloyed refractory carbide additive or grains may comprise comminuted scrap material or comminuted freshly sintered material. Examples of various pre-alloyed compositions which may be employed as an additive to metal powders are given as follows:

(a) 34.5% TiC by weight and the balance essentially a steel matrix, said matrix containing by weight 10% Cr, 2.9% Mo, 0.85% C and the balance essentially iron.

(b) 25% by weight TaC and the balance essentially a steel matrix, said matrix containing 3% Cr, 3% Mo, 0.5% C and the balance essentially iron.

(c) 45% by weight TiC and the balance essentially a steel matrix, said matrix containing 55.5% Cr, 1.2% Mo, 0.3% Si, 0.3% V, 1% C, 0.2% misch metal and the balance essentially iron.

(d) 55% NbC by weight and the balance essentially a steel matrix, said matrix containing 18% Ni, 8.5% Co, 4.75% Mo, 1% Ti and the balance essentially iron.

(e) 20% TiC by weight and the balance essentially a steel matrix, said matrix containing 5% Cr, 4% Mo, 0.5% Ni, 0.4% C and the balance essentially iron.

(f) 50% VC by weight and the balance essentially a nickel-base matrix, the matrix containing 18% CR, 8% Fe, 2% Ti, 1% Al and the balance essentially nickel.

(g) 20% TiC by weight and the balance essentially a nickel-base matrix, said matrix containing 5% Cr, 12% Fe, 10% Co, 3% Ti, 2% Al and the balance essentially nickel.

(h) 25% TiC by weight and the balance essentially a nickel-chromium containing iron-base matrix, said matrix containing 30% Ni, 22% Cr, 1.5% Mn, 1.5% Ti, 1% Al and the balance essentially iron.

The method embodiment of the invention for producing sintered wear-resistant shapes from metal powder comprises mixing about 5% to 20% by weight of said pre-alloyed refractory carbide grains with particulate material selected from the group consisting of iron-base, nickel-base, aluminum-base, copper-base and beryllium-base metal powders making up essentially the balance, the pre-alloyed refractory carbide grains consisting essentially by weight of about 15% to 60% of said refractory carbide powder dispersed by liquid phase sintering through a metal matrix selected from the group consisting of iron-base and nickel-base metals making up the balance. The mixture is formed into a desired shape by compaction to a density of over 70% of the theoretical density of the composition following which the compacted shape is sintered under substantially non-oxidizing conditions (e.g. under neutral, reducing or vacuum conditions) at a temperature of at least about 75% of the absolute melting point (degrees Kelvin) of the matrix metal, the sintering temperature in degrees centrigrade being determined as at least about 75% of the absolute melting point in degrees Kelvin less 273°, the temperature being below the melting point of said matrix metal powder and preferably not exceeding 5° C. below the incipient melting point of said matrix metal.

In a preferred embodiment, the sintering temperature in degree centigrade may range from about 80% to 95% of the absolute melting point of the matrix metal less 273°.

As illustrative of the various embodiments of the invention, the following examples are given.

EXAMPLE 1

A pre-alloyed titanium carbide tool steel known by the trademark "Ferro-TiC" was employed as the refractory carbide additive. The composition contained 33% by weight of TiC dispersed in a matrix of steel, the steel composition comprising about 3% Cr, 3% Mo, 0.6% C and the balance essentially iron. As described herein, the titanium carbide tool steel was produced by liquid phase sintering a compact of the foregoing composition (i.e. 33% by weight TiC and 67% of the steel-forming powder) in vacuum at a temperature of about 1450° C. for about one-half hour.

About 10% by weight of the foregoing sintered composition in particulate form was mixed with 90% by weight of an alloy powder containing 4% Cu and 1% C and the balance iron. The mixture was compacted at a pressure of 37 to 40 TSI (tons/sq.in.) to a density of about 6.4 gr/cm$^3$, or a density of about 85% of the theoretical density of the final composition.

The compact was then sintered in an endothermic atmosphere at a temperature of about 2050° F. (1123° C.) for 1 hour, the sintering temperature in degrees Kelvin corresponding to about 81% of the absolute melting point of the steel matrix which has a melting point in the neighborhood of 1450° C. or about 1723° K. ([1396° K.÷1723° K.]×100).

The steel matrix without the pre-alloyed carbide addition was similarly compacted and sintered at the same temperature. The sintered steel without the carbide addition exhibited a density of 6.54 gr/cm$^3$, a change in length of +0.0005 inch, a hardness of 84 $R_B$ and a tensile strength of 73,400 psi. On the other hand, the sintered steel with the 10% carbide addition exhibited a sintered density of 6.32 gr/cm$^3$, a change in length of +0.0060 inch, a hardness of 86 $R_B$ and a tensile strength of about 46,700 psi.

While the steel with the carbide addition showed a drop in tensile strength, the resistance to wear was markedly improved over the steel without the carbide addition, although both test specimens exhibited the same coefficient of friction. The wear test employed is described below.

The coefficient of friction and the resistance to wear are determined by using a system shown schematically in FIG. 1. A metal ring 10 of 4620 steel hardened to $R_C$ 59 to 61 is provided mounted on a rotatable arbor 10A. A block 11 of the sintered composition is freely supported on the top of the ring as shown with a predetermined load 12, e.g. 13.23 lbs., applied to the block. The arbor is caused to rotate at 180 rpm and the force of friction 13 then applied via a suitable element to friction load pick-up means 14 which translates the force to a reading on friction load indicator or gage 15. The gage reading is divided by the load 12 on the block to provide the coefficient of friction. In addition, the amount of volumetric wear was measured.

A running time of about 4 hours was taken as the standard running period. The coefficient of friction was determined and, following completion of the test, the amount of wear was measured in terms of volume of material worn away.

The coefficient of friction for the sintered material with and without the pre-alloyed carbide addition was 0.151. However, the material without the carbide addition exhibited a wear corresponding to a volume loss of $77.84\times10^{-5}$cm$^3$. On the other hand, the sintered material with 10% by weight of the pre-alloyed carbide exhibited a lower wear of $58.75\times10^{-5}$cm$^3$ which corresponds to about 23.5% less wear.

The same sintered material with 5% by weight of the pre-alloyed carbide powder had a density of 6.44 gr/cm$^3$, a hardness of 86.5 $R_B$, a tensile strength of 54,800 psi, a coefficient of friction of about 0.151 and a volume loss of about $66.25\times10^{-5}$cm$^3$ which corresponds to about 15% less wear than the same sintered composition without the pre-alloyed carbide addition.

A representation of a micrograph of the 10% pre-alloyed carbide addition produced at 1000 times magnification is illustrated in FIG. 2 which shows an approximately 50 micron particle 16 of the pre-alloyed titanium carbide additive disposed in the sintered steel matrix, the dark areas being pores. The density of the sintered compact is about 90% of theoretical density of the composition.

FIG. 3 is similar to FIG. 2 except the micrograph is shown at 4000 times magnification and shows the pre-alloyed titanium carbide grain containing a cluster of titanium carbide particles having substantially a rounded configuration.

EXAMPLE 2

The use of the pre-alloyed carbide addition for improving the wear resistance of the nickel-base alloy known by the trademark "Inconel" is given as follows:

The "Inconel" material in powder form (72% Ni, 16% Cr, 8% Fe, 2% Si and the balance residuals) is uniformly mixed with 15% by weight of a pre-alloyed liquid phase sintered niobium carbide material containing 55% NbC and the balance essentially a steel matrix, the steel matrix containing 5.5% Cr, 1.2% Mo, 0.3% Si, 0.3% V, 1% C, 0.2% misch metal and the balance essentially iron. The powders have an average particle size of less than 250 mesh (U.S. Standard Screen).

The mixed powders are compacted at a pressure of about 70 TSI and the compact is sintered in vacuum (less than 20 microns of mercury) at a temperature of about 2030° F. (1110° C.) for about 60 minutes. The Inconel alloy has a melting temperature of approximately 1385° C. which corresponds to 1660° K, the sintering temperature corresponding to 1383° K. Thus, the sintering temperature is approximately 83% of the absolute melting point. The resulting sintered product is characterized by a metallographic microstructure with grains of pre-alloyed NbC distributed through the nickel-base alloy matrix and well bonded to the matrix via the pre-alloyed interface of the carbide.

EXAMPLE 3

A copper-tin alloy powder containing 90% Cu and 10% Sn is employed as the matrix metal in the production of a wear resistant part containing titanium carbide.

About 20% by weight of a pre-alloyed liquid phase sintered titanium carbide is employed as the additive, the prealloyed carbide containing by weight 25% TiC and the balance a nickel-base alloy containing 5% Cr, 12% Fe, 10% Co, 3% Ti, 2% Al and the balance essentially nickel.

Thus, 20% by weight of the foregoing pre-alloyed composition is added to 80% by weight of the 90 Cu-10 Sn powder, the particle size of both powders being less than 200 mesh (U.S. Standard Screen). The powders are uniformly mixed and compacted at a pressure of about 50 TSI. The compact is sintered in a hydrogen atmosphere at a temperature of about 780° C. for about 1 hour. The 90 Cu-10 Sn alloy has a melting point of about 950° C. or about 1223° K. Thus, the sintering temperature is about 86% of the absolute melting point of the Cu-Sn alloy. By virtue of the presence of the pre-alloyed titanium carbide material, the resulting sintered copper-base composition has enhanced resistance to wear.

EXAMPLE 4

A sintered aluminum product is produced by adding a pre-alloyed refractory carbide material to aluminum powder.

The pre-alloy carbide material which is produced by liquid phase sintering comprises 20% by weight of TaC dispersed through a steel matrix containing by weight 10% Cr, 2.9% Mo, 0.85% C and the balance essentially iron.

About 20% by weight of the foregoing pre-alloyed refractory carbide material is uniformly mixed with aluminum powder known by the designation MD 69 containing by weight 98.05% Al, 0.25% Cu, 1.0% Mg, 0.6% Si, and 0.1% Cr, the powder passing through a 60% mesh screen with about 35% passing through 325 mesh screen.

The mixed powders are compacted at a pressure of 38 TSI to a density of about 2.5 gr/cm$^3$ and sintered at a temperature of about 580° C. in vacuum. The powder has a melting point in the neighborhood of about 660° C. or 933° K., the sintering temperature corresponding to 853° K. As will be noted, the sintering temperature is approximately 91% of the absolute melting point of the aluminum-base matrix.

The sintered product exhibits enhanced resistance to wear and abrasion, considering that the aluminum matrix is soft.

The invention is also applicable to the production of sintered beryllium products, such as a bearing for aerospace applications. For example, 10% by weight of the pre-alloyed titanium carbide tool steel of the composition disclosed in Example 1 may be mixed in the finely divided form with fine particles of beryllium, compacted at about 60 TSI and then sintered in vacuum at about 1125° C. for a time sufficient to reach the desired density.

EXAMPLE 5

A nickel-base alloy powder containing 70% Ni and 30% Cu is improved in wear resistance by uniformly mixing with the powder 15% by weight of a pre-alloyed liquid phase sintered refractory carbide material containing by weight 50% TiC and the balance a steel matrix containing by weight 5% Cr, 4% Mo, 0.5% Ni, 0.4% C and the balance essentially iron. The powders have a particle size less than 150 mesh in size.

The mixed powders are compacted at a pressure of about 40 TSI and then sintered at a temperature of about 1100° C. for about 1 hour in vacuum at less than 20 microns of mercury pressure. The Ni-Cu alloy has a melting point between 1335° C. and 1365° C. or an average about 1350° C. which corresponds to 1623° K., the sintering temperature corresponding to 1373° K. Thus, the sintering temperature is about 83% of the absolute melting point of the Ni-Cu matrix alloy. The resulting sintered P/M product has greatly enhanced resistance to wear.

Broadly speaking, the powders blended together in forming the final sintered shape will generally have a particle size less than about 100 mesh and usually less than about 200 mesh with at least about 25% of the powder passing through 325 mesh screen.

The pre-alloyed refractory carbide grains generally comprise a cluster of refractory carbide powders dispersed through the alloying metal with which the particles are associated. This will be observed by looking at FIG. 2 of the drawing in which a pre-alloyed grain 16 of about 50 microns in size is shown.

In producing the shape of sintering, the usual amounts of pressing lubricants are employed. The compacting pressure may range from about 15 TSI to as high as about 70 TSI, depending on the nature of the powders being pressed to achieve a green density of at least about 75% or 80% of the theoretical density of the composition.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. As an article of manufacture, a sintered metal shape of a matrix metal selected from the group consisting of iron-base, nickel-base, copper-base and aluminum-base metals having dispersed therethrough about 5% to 20% by weight of pre-alloyed grains of a refractory metal carbide with the metal matrix making up essentially the balance, said pre-alloyed refractory carbide grains dispersed through said matrix being less than 100 mesh in size and consisting essentially of about 15% to 60% by weight of refractory metal carbide alloyed with a metal from the group consisting of iron-base and nickel-base metals making up essentially the balance of said grains, said sintered shape being characterized by enhanced resistance to wear and abrasion.

2. The sintered shape of claim 1, wherein the refractory metal carbide making up said pre-alloyed refractory carbide grains is selected from the group consisting of TiC, VC, NbC and TaC.

3. The sintered shape of claim 2, wherein the refractory carbide consists essentially of rounded grains of TiC.

4. The sintered shape of claim 3, wherein the TiC pre-alloyed carbide in the grains is associated with an iron-base metal.

5. The sintered shape of claim 3, wherein the TiC in the pre-alloyed carbide grains is associated with a nickel-base metal.

6. The sintered shape of claim 4, wherein the TiC in the pre-alloyed carbide grains is associated with a steel composition selected from the group consisting of:

(1) about 1% to 6% Cr, up to about 6% Mo, up to about 2% V, up to about 3% Co, up to about 2% Ni, about 0.3% to 0.8% C and the balance essentially iron;

(2) about 6% to 12% Cr, about 0.5% to 5% Mo, about 0.6% to 1.2% C, up to about 5% W, up to about 2% V, up to about 3% Ni, up to about 5% Co and the balance essentially iron; and (3) about 3% to 7% Cr, about 2% to 6% Mo, about 0.1% to 1% Ni, about 0.3% to 0.7% C and the balance essentially iron.

7. As an article of manufacture, a sintered metal shape of a matrix metal selected from the group consisting of iron-base, nickel-base, copper-base and aluminum-base metals having dispersed therethrough about 5% to 20% by weight of pre-alloyed rounded grains of titanium carbide with a steel matrix making up essentially the balance, said pre-alloyed grains having a particle size of less than 100 mesh, said steel matrix having a composition selected from the group consisting of:

(1) about 1% to 6% Cr, up to about 6% Mo, up to about 2% V, up to about 3% Co, up to about 2% Ni, about 0.3% to 0.8% C and the balance essentially iron;

(2) about 6% to 12% Cr, about 0.5% to 5% Mo, about 0.6% to 1.2% C, up to about 5% W, up to about 2% V, up to about 3% Ni, up to about 5% Co and the balance essentially iron; and (3) about 3% to 7% Cr, about 2% to 6% Mo, about 0.1% to 1% Ni, about 0.3% to 0.7% C and the balance essentially iron;

said pre-alloyed rounded grains of titanium carbide consisting essentially of about 15% to 60% by weight of said titanium carbide of said pre-alloyed composition, said sintered shape being characterized by enhanced resistance to wear and abrasion.

8. The article of manufacture of claim 7, wherein the sintered metal shape is an iron-base metal.

9. The article of manufacture of claim 7, wherein the sintered metal shape is a nickel-base metal.

10. The article of manufacture of claim 7, wherein the sintered metal shape is a copper-base metal.

11. The article of manufacture of claim 7, wherein the sintered metal shape is an aluminum-base metal.

* * * * *